United States Patent [19]

Vliet

[11] 4,026,369

[45] May 31, 1977

[54] YIELD TORQUE APPARATUS

[75] Inventor: Walter C. Vliet, Landing, N.J.

[73] Assignee: Ingersoll-Rand Company, Woodcliff Lake, N.J.

[22] Filed: Oct. 6, 1975

[21] Appl. No.: 619,656

[52] U.S. Cl. ..... 173/12; 81/52.4 B

[51] Int. Cl.[2] ..... E21C 5/00

[58] Field of Search ..... 173/12; 73/136 R, 139; 81/52.4, 52.4 B, 52.5

[56] References Cited

UNITED STATES PATENTS

| | | | |
|---|---|---|---|
| 3,520,215 | 7/1970 | Lucenti et al. | 173/12 X |
| 3,623,557 | 11/1971 | Allen | 173/12 |
| 3,643,501 | 2/1972 | Pauley | 73/139 |
| 3,693,726 | 9/1972 | Hornig | 73/139 X |
| 3,745,820 | 7/1973 | Weiner | 173/12 |

*Primary Examiner*—Ernest R. Purser

*Assistant Examiner*—Richard E. Favreau

*Attorney, Agent, or Firm*—Walter C. Vliet

[57] ABSTRACT

A wrenching apparatus for torquing a fastener to its yield point and automatically shutting off once the yield point is reached. The yield point is sensed by having the wrenching apparatus resiliently restrained and creating a pulse signal in response to an increment of restraint. Rotational output of the wrenching apparatus also creates a pulse for each increment of rotation chosen. The rotational pulses are counted and the restraint pulses are utilized to cancel the sum of the rotational pulses. The yield point is detected when the sum of the rotational pulses exceeds a predetermined number without having received a restraint pulse cancellation. The count system is activated only after a predetermined level of total restraint is achieved thereby assuring the fastener is seated and the fastener tension is increasing in its linear range.

9 Claims, 1 Drawing Figure

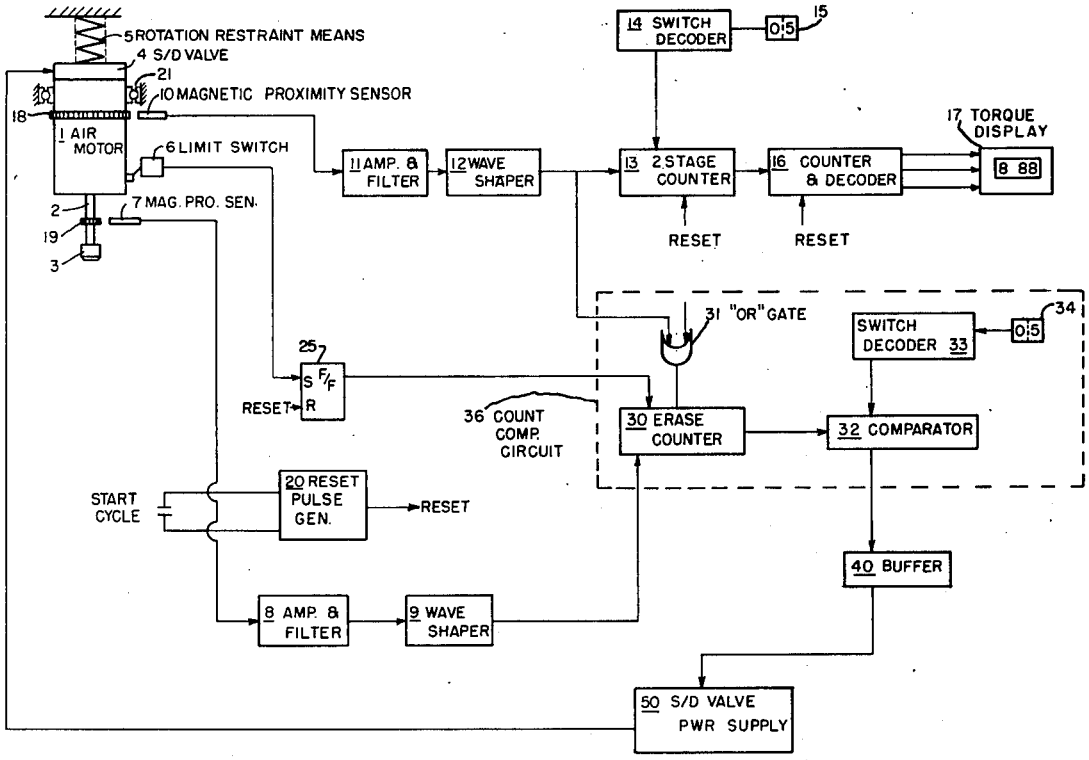

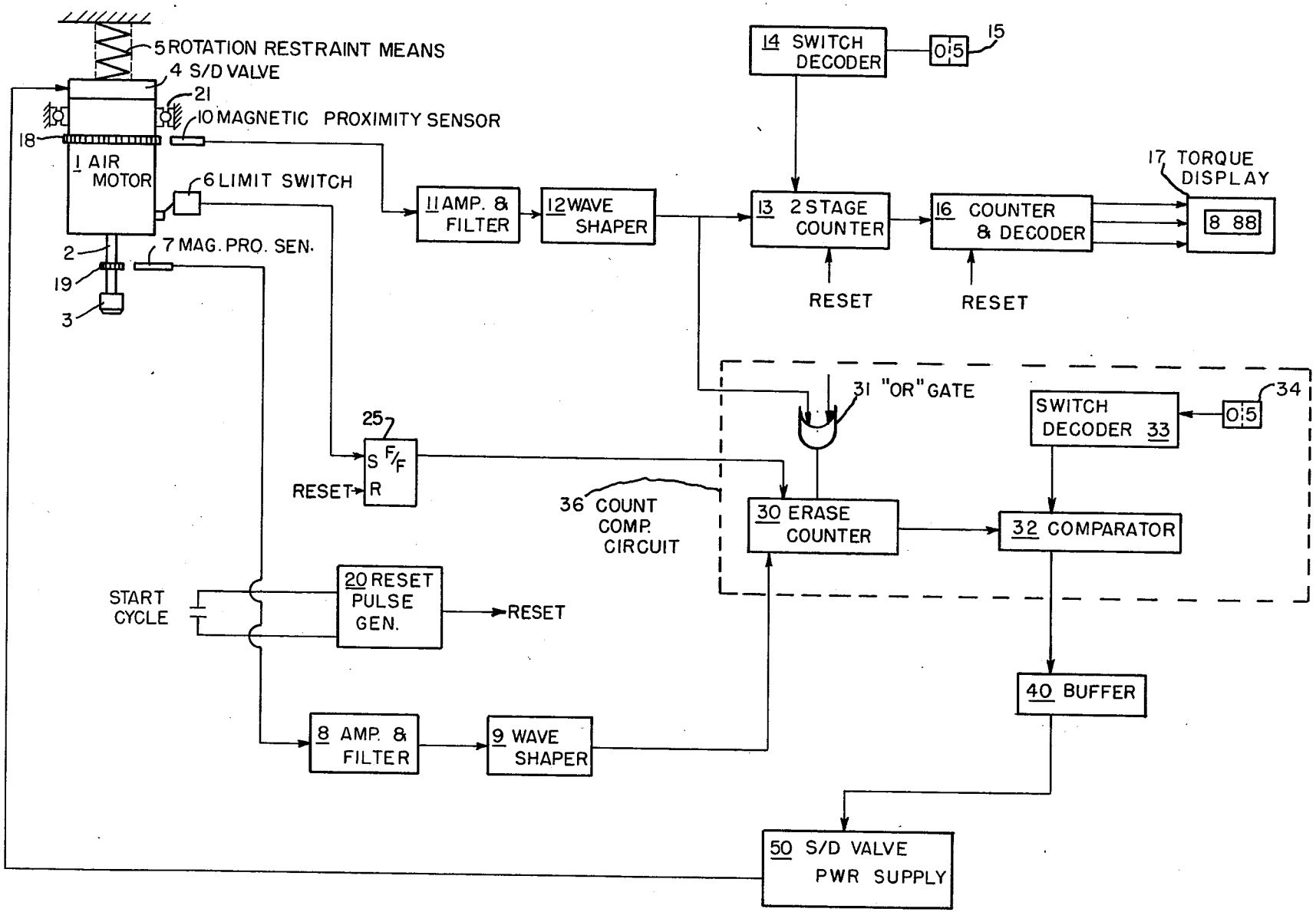
17 TORQUE DISPLAY
8 88
16 COUNTER & DECODER
RESET
15
0:5
14 SWITCH DECODER
13 2 STAGE COUNTER
RESET
12 WAVE SHAPER
11 AMP. & FILTER
34
0:5
SWITCH DECODER 33
32 COMPARATOR
40 BUFFER
31 "OR" GATE
30 ERASE COUNTER
50 S/D VALVE PWR SUPPLY
36 COUNT COMP. CIRCUIT
RESET
9 WAVE SHAPER
25
S F/F R
RESET
20 RESET PULSE GEN.
8 AMP. & FILTER
5 ROTATION RESTRAINT MEANS
4 S/D VALVE
21
10 MAGNETIC PROXIMITY SENSOR
6 LIMIT SWITCH
7 MAG. PRO. SEN.
1 AIR MOTOR
2
19
3
18
START CYCLE

YIELD TORQUE APPARATUS

BACKGROUND OF THE INVENTION

Accurate control over the torque applied to threaded fasteners is of increasing importance in assembly operation. Numerous devices have been utilized in the past to shut off the power supply or to disengage the power tool from the fastener at a predetermined torque output. The resulting tension produced in the fastener generally has not been within the required tolerances, or at a sufficiently high level for maximum fastener utilization. Several methods have been developed recently to improve the level of fastener utilization by taking the fastener to a relatively high tension level, including to its yield point. The methods disclosed to date have required relatively sophisticated electronic apparatus to acomplish their function. Most of these methods have required the use of output torque transducers and angular position encoders coupled with differentiating circuitry either mechanical or electrical.

The present invention obviates the need for elaborate equipment. It is well known in the art that after the threaded fastener has been run down and firmly seated, the tension in the fastener becomes proportional to the further rotation of the fastener until the fastener or its mating threads begin to yield. At this point, further rotation of the fastener will not result in a proportional increase in the tension in the fastener. In addition, as the fastener is rotated, the torque applied to the fastener increases proportionately until the yield point is reached. At the yield point, an increase in the applied torque will result in greater fastener rotation than when the fastener is in its proportional range. It is this occurrence on which the present invention is predicated.

SUMMARY OF THE INVENTION

The present invention utilizes a simple incremental pulse and counting/erase technique to determine the fastener yield point. As the output spindle of the present wrenching apparatus rotates, it produces an incremental pulse for a selected amount of rotation. In addition, the wrenching apparatus is resiliently or rotationally mounted such that the reaction torque from rotating the fastener will result in an increase in the restraint required to prevent the wrenching apparatus from rotating. A pulse is created for a chosen increment of restraint required.

I have devised an apparatus for counting the rotational pulses and utilizing the increase in restraint pulses to cancel the total count of rotational pulses once the wrenching apparatus has reliably seated the fastener. The total count of incremental restraint pulses may be utilized to establish the overall level of torque applied to the fastener provided the restraining system operates linearly over the full range of fastener torque experienced.

The yield point detection apparatus of the present invention is activated only after the fastener is reliably seated. At this point, the apparatus begins to count the rotational output pulses utilizing the increase in restraint pulses to cancel the rotational count. A separate running torque count may be retained as an indicator of total torque applied to the fastener, however, the count utilized for yield point detection is erased by the restraint count. For example, in the proportional range of fastener tension, the apparatus may be set to supply five counts of rotation as a limit before a restraint count is received or the wrenching apparatus will shut off.

The object of the invention is to produce a wrenching apparatus having a simple means for detecting fastener yield point. It is the further object of this invention to shut the wrench off in response to the yield point detection. It is still a further object of this invention to incorporate a feature of checking or inspecting the torque applied to the fastener and the condition of the fastener unit. These and other objects are obtained in a wrenching apparatus for simultaneously tightening a fastener and sensing the stress-strain relationship in the fastener to determine when yield has ocurred in the fastener unit comprising: A wrench for tightening a fastener having its rotational and torque output on a wrench spindle; a wrench mounting means for allowing at least some rotation of the wrench body; a resilient means for restraining the rotation of said wrench; a first measurement means for determining the magnitude of restraint required to prevent rotation of the wrench body and produce a torque pulse signal in response to an increment of the magnitude of restraint; a second measurement means for determining the rotation of the wrench spindle and producing a rotation pulse signal in response to an increment of spindle rotation; means for receiving and totaling the number of rotation pulse signals; means for receiving the torque pulse signal and for cancelling the total number of rotation pulse signals in response to a torque pulse signal received; and means for shutting off the wrench in response to a preselected total of the rotation pulse signal having been exceeded.

BRIEF DESCRIPTION OF THE DRAWING

FIG. 1 is a schematic drawing of the yield point tension control and inspection system of this invention.

DESCRIPTON OF THE PREFERRED EMBODIMENT

Referring to FIG. 1; an air motor generally designated as 1 is shown. The air motor has its rotational output on a spindle 2 which in turn rotates a socket 3 for engaging a fastener (not shown). The air motor is equipped with a high-speed shut-off device such as a solenoid operated valve 4 (shown in block form) in the embodiment shown. The air motor body is rotatively mounted by means of a bearing 21 and restrained from rotation by a torque spring 5. In this manner, it can be seen that as the air motor rotates a fastener and the torque required to rotate the fastener increases, the motor being rotatively mounted and restrained by a resilient means will tend to rotate in a direction opposite to the spindle rotation.

A limit switch 6 is utilized to sense a particular degree of motor rotation without interfering with the motor rotation. The operation and importance of the limit switch 6 will be explained later. Spindle rotation is sensed by a magnetic proximity sensor 7; the output of the magnetic proximity sensor 7 is sent to an output rotation pulse amplifier and filter 8 for amplificaton of the signal and filtering of noise. The amplified and filtered output rotation signal is then sent to a signal wave shaper 9 to produce a distinct wave pulse for each chosen increment of output rotation. The function of this pulse signal will be explained later. As the air motor rotates against torque spring 5, a motor rotation proximity sensor 10 produces a pulse signal which in turn is amplified and filtered in motor rotation pulse amplifier and filter 11. The rotation pulse signal is then sent to wave shaper 12 to produce a suitable motor rotation pulse signal. Both the motor rotation pulse signal and the spindle rotation pulse signal are modified by their respective wave shaper to a square wave signal for use in the digital circuit described below.

The motor rotation pulses are fed into an initial two-stage counter 13 which divides the number of input pulses (counts) by a value selected in the switch decoder 14. The value selected is entered by means of digital switch 15. By knowing the characteristics of the motor torque spring 5 and the number of pulses per revolution from the proximity sensor 10 (motor rotation sensor), the number of counts per foot pound can be determined. This value is set into the digital switch 15. The result is one pulse per foot pound output from the initial two-stage counter 13. The one pulse per foot pound signal is fed to a stage counter and segment decoder 16 which converts the count to a display value on the torque display 17.

The operation so far described is well known in the art for producing torque readouts in wrenching apparatus. In addition, the function of the reset pulse generator 20 to reset the various counters utilized in the invention and to start the torquing cycle should also be well understood. Limit switch 6 which senses a particular degree of motor rotation is utilized to set a flip-flop enable function causing the erase counter 30 to be enabled (start counting).

Once the erase counter has received the enable function, it is ready to start counting spindle rotation pulses, and it begins to do so. Since the point at which the limit switch 6 triggers the flip-flop is chosen at a torque output which insures the fastener is in its proportional range of tension, a continued rotation of the spindle will produce a porportional rotation of the motor. As explained before, a portion of the signal generated by the magnetic proximity sensor 10 is utilized to provide a total torque display. The rotation pulse signal is also fed to an "or" gate 31 which in turn is fed to the erase counter and serves to reset or erase the spindle rotation count. The "or" gate 31 also receives the initial reset pulse to clear the count at the start of the torquing cycle.

The erase counter 30 forms a part of a circuit which may be called the count comparator circuit 36 enclosed by a dotted line on FIG. 1. The count comparator circuit 36 is further composed of a comparator 32, a switch decoder 33, and a digital switch 34. The function of the count comparator circuit is to produce a pulse which is sent to buffer 40 and used to trigger the solenoid valve power supply 50 and in turn shut off solenoid valve 14 and thereby the wrenching apparatus. The counter comparator circuit produces the required pulse by having the comparator compare the erase counter count with the count set in by means of digital switch 34 and switch decoder 33. When the erase counter count equals the switch decoder count, a shut off pulse is produced.

In summary, the operation will now be understood as follows: A discreet pulse is produced for a chosen amount of spindle rotation. The spindle rotation pulse is sent to the erase counter 30. Once a predetermined level of torque has been applied to the fastener, the erase counter is enabled by means of limit switch 6 and the erase counter begins to count. Simultaneously, as the torque output of the wrenching apparatus increases, the wrench body or motor begins to rotate against the known restraint producing a discreet motor rotation pulse.

In the preferred embodiment, the motor rotation pulse is utilized to indicate the total torque, and, in addition, utilized to erase the erase counter count. When the fastener is in its proportional range of tension, an erase signal will be received before a predetermined count of spindle rotation has been received. Once the fastener begins to yield, however, the torque increase will no longer be proportional to the spindle rotation and spindle count will exceed the preselected allowable count and the comparator 32 will issue a shut off signal.

It should be obvious to one skilled in the art that several modifications of the preferred embodiment may be made without departing from the spirit of the invention as the same will now be understood. For example if a total torque display or measurement is not required, the stage counter 13, the stage counter and segment decoder 16, the torque display 17, the switch decoder 14, and the digital switch 15 may be eliminated. In addition, although magnetic proximity sensors are shown to sense rotation, any convenient means such as photo electric, piezoelectric, or electric switch means may be employed. Some of these means will function satisfactorily without the aid of the amplifier and filter and wave shaper shown in the preferred embodiment. The output of the spindle rotation circuit may be fed directly through the limit switch to the erase counter by making the limit switch open until the predetermined torque has been established and then closing the switch thus allowing the spindle rotation pulse to go to the erase counter. In this manner, the flip-flop enable function may be eliminated.

Where high speed operation is not critical, the functions of the erase counter may be accomplished by means of a simple stepping escape mechanism which is reset by the motor rotation. Although I have shown a rotatively mounted wrenching apparatus, it is not necessary that the wrenching apparatus freely rotate. It may be resiliently mounted and restrained by a device such as a torque transducer. For purpose of FIG. 1, the torque transducer would replace torque spring 5 and is represented on FIG. 1 as a dotted line sharing reference numeral 5. The output of the torque transducer would be stepped to provide a distinct pulse and may be utilized in a manner similar to the magnetic proximity sensor as described before. With suitable electronic circuitry, it should be obvious to one skilled in the art that the function of the limit switch may also be eliminated by utilizing a preset level of total torque as an enable function for the erase counter.

The preferred embodiment described may also be utilized as a fastener inspection system; in that, yield point for a given fastener system should occur within a given range of torque output. Thus, if the wrenching apparatus shuts off before a minimum torque has been achieved or if the torque achieved exceeds the maximum norm for the system, then one can conclude something is wrong with the fastener unit. For example, a gasket has been left out or it is the wrong type, a wrong grade of bolt has been utilized, the thread of either the bolt or its mating part are damaged or dirty, or the fastener has been cross threaded. Numerous other modifications will occur to one skilled in the art and I do not wish to be limited in the scope of my invention except as limited by the scope of the claims.

I claim:

1. A wrenching apparatus for simultaneously tightening a fastener and sensing the stress-strain relationship in the fastener to determine when yield has occurred in the fastener unit comprising:

a wrench including a wrench body for tightening a fastener having its rotational and torque output on a wrench spindle;

a wrench mounting means for allowing at least some rotation of the wrench body in reaction to the torque output on said wrench spindle;

a resilient means for restraining the rotation of said wrench body;

a first measurement means for determining the magnitude of restraint required to prevent rotation of said wrench body and produce a torque pulse signal in response to an increment of said magnitude of restraint;

a second measurement means for determining the rotation of said wrench spindle and producing a rotation pulse signal in response to an increment of spindle rotation;

means for receiving and totaling the number of rotation pulse signals;

means for receiving the torque pulse signal and for cancelling the total number of rotation pulse signals in response to a torque pulse signal received; and means for shutting off said wrench in response to a preselected total of said rotation pulse signal having been exceeded.

2. The apparatus of claim 1 wherein:

said second measurement means is an angular position encoder of the type that produces a pulse for an increment of rotation.

3. The apparatus of claim 1 wherein:

said means for receiving and totaling the number of rotation pulse signals is activated after a preselected magnitude of restraint is obtained.

4. The apparatus of claim 3 wherein:

said resilient means allows rotation of said wrench only after a preselected magnitude of restraint is achieved.

5. The apparatus of claim 1 wherein:

said wrench body is rotatively mounted.

6. The apparatus of claim 5 wherein:

said resilient means is a spring means.

7. The apparatus of claim 1 wherein:

said first measurement means is a torque transducer means.

8. The apparatus of claim 7 wherein:

said torque transducer means is also the resilient means for restraining the rotation of said wrench.

9. A wrench apparatus for simultaneously tightening a threaded fastener and sensing the stress-strain relationship in the fastener to determine when yield has occurred and shut the wrench off comprising:

a rotatively mounted wrench having a rotational output on a spindle for driving a fastener;

means for restraining the rotation of said wrench and producing a first incremental pulse in proportion to the restraint;

means for creating a second pulse in response to an increment of rotation of said spindle;

means for receiving and counting said second pulse in response to a predetermined total restraint;

said means for receiving and counting said second pulse being reset to zero by receiving said first incremental pulse; and means for shutting off said wrench in response to a preselected total count of said second pulse greater than one.

* * * * *